166-307
4/7/81 XR 4,260,020

United States Patent [19]

Nelson et al.

[11] 4,260,020

[45] Apr. 7, 1981

[54] METHOD AND TOOL FOR CONTROLLING FLUID FLOW FROM A TUBING STRING INTO A LOW PRESSURE EARTH FORMATION

[75] Inventors: Wayne F. Nelson, Waxahachie; Derrel G. Gurley, Houston, both of Tex.

[73] Assignee: The Dow Chemical Company, Midland, Mich.

[21] Appl. No.: 71,978

[22] Filed: Sep. 4, 1979

[51] Int. Cl.[3] ..... E21B 37/08; E21B 43/25; E21B 43/26

[52] U.S. Cl. ..... 166/305 R; 166/307; 166/308; 166/312; 166/325

[58] Field of Search ..... 166/305 R, 307, 308, 166/325, 319, 320; 137/515, 515.5, 515.3, 538

[56] References Cited

U.S. PATENT DOCUMENTS

| | | | |
|---|---|---|---|
| 2,128,352 | 8/1938 | Creighton | 166/325 X |
| 2,757,741 | 8/1956 | O'Reilly | 166/325 X |
| 3,014,531 | 12/1961 | Weaver | 166/325 X |
| 3,022,829 | 2/1962 | Hodges | 166/325 |
| 3,845,784 | 11/1974 | Sullivan | 166/325 X |
| 4,050,516 | 9/1977 | Canterbury | 166/305 R |
| 4,072,166 | 2/1978 | Tirapolsky et al. | 166/325 X |

*Primary Examiner*—Stephen J. Novosad
*Attorney, Agent, or Firm*—V. Dean Clausen

[57] ABSTRACT

A tool is disclosed for controlling flow of treating fluid from a tubing string into an earth formation, in which the bottom hole pressure is less than the hydrostatic pressure of the fluid in the string. In another application, the tool is used in conjunction with a wash tool to wash sediment out of casing perforations and slotted liners. Before the downhole operation is commenced, a slidable piston in this tool closes off fluid outlet ports, to prevent the fluid from "gravity flowing" out of the tubing string. The piston is held in the closed position by the co-action of an adjusting bolt and a compression spring. The fluid is released from the tubing string by applying sufficient fluid pressure against the piston to overcome the spring load and thus move the piston downwardly past the fluid outlet port.

8 Claims, 2 Drawing Figures

METHOD AND TOOL FOR CONTROLLING FLUID FLOW FROM A TUBING STRING INTO A LOW PRESSURE EARTH FORMATION

BACKGROUND OF THE INVENTION

The invention relates broadly to a tool for controlling flow of fluid from a tubing string into a low pressure earth formation. More specifically, the invention covers a tool capable of holding the fluid in a tubing string, in a formation having a bottom hole pressure less than the hydrostatic pressure of the fluid in the string, until a predetermined pressure is applied to the tool to release the fluid.

When a wellbore is drilled into earth formations which have low fluid levels, the bottom hole pressure in the wellbore will be very low. This low pressure condition in the well casing can create a problem with regard to treating the formation with acids or other treating fluids. For example, if the pressure at the face of the formation to be treated is less than the hydrostatic pressure of the fluid in the tubing string at that depth, a means must be provided to hold the treating fluid in the tubing string until it reaches the zone to be treated. Otherwise, the low pressure condition in the wellbore will allow the treating fluid to "gravity flow" out of the tubing string.

Various attempts have been made to solve the problem described above. The closest prior art we are aware of is described in U.S. Pat. No. 4,050,516, granted to Dresser Industries Inc. The invention described in this patent is a spring-loaded valve, which is fastened to the end of the tubing string. In the valve device is a flow chamber which communicates with the well casing, to allow fluid to flow into the formation.

During run-in of the tubing string, the force of the spring keeps the valve head seated in an access opening at the bottom of the flow chamber. Part of the fluid in the tubing string bypasses the flow chamber and enters a pressure balancing chamber below the valve head. The fluid in the pressure balancing chamber thus exerts an upward pressure against the opposite end of the valve head. The force of the spring and the pressure exerted by the bypassing fluid are able to overcome the hydrostatic pressure of the fluid against the valve head and thus prevent the fluid from entering the flow chamber. To release fluid through the flow chamber and into the formation, a sufficient amount of pressure is applied against the fluid in the tubing string to overcome the upward force against the valve head.

SUMMARY OF THE INVENTION

The present invention provides a tool and method of operation for controlling fluid flow into a low pressure earth formation. The tool includes an elongate coupling having a top end which connects onto a piston housing. At the bottom end the coupling connects into a lower tubing string section. The coupling encloses the piston housing and is spaced from the housing. The space defined between the piston housing and the coupling provides an annular chamber. The piston housing also includes at least one fluid outlet port which communicates with the annular chamber. In addition, the top end of the piston housing is adapted for connecting into an upper section of a tubing string.

A tubular piston is positioned inside the housing, such that it is slidable within the housing. The top face of the piston has a a larger surface area than the bottom face of the piston. In operation, the piston can be moved to a first position which closes off the fluid outlet ports; and to a second position which opens the fluid outlet ports. Another component of the tool is an adjusting member which has a head portion. The adjusting member is mounted at the bottom end of the piston housing, such that it can move up and down within the housing. An elastic member seats against the head of the adjusting member and against the bottom face of the piston.

When the tubing string is lowered into a well casing to perform the treating job, the co-action of the adjusting member and the elastic member hold the piston in the closed position, such that the fluid outlet ports are closed. When it is desired to release the fluid from the tubing string, sufficient fluid pressure is applied against the top face of the piston to move the piston below the fluid outlet ports, so that the fluid can pass through the annular chamber and into the lower tubing string section.

DESCRIPTION OF PREFERRED EMBODIMENTS

Figure 1:
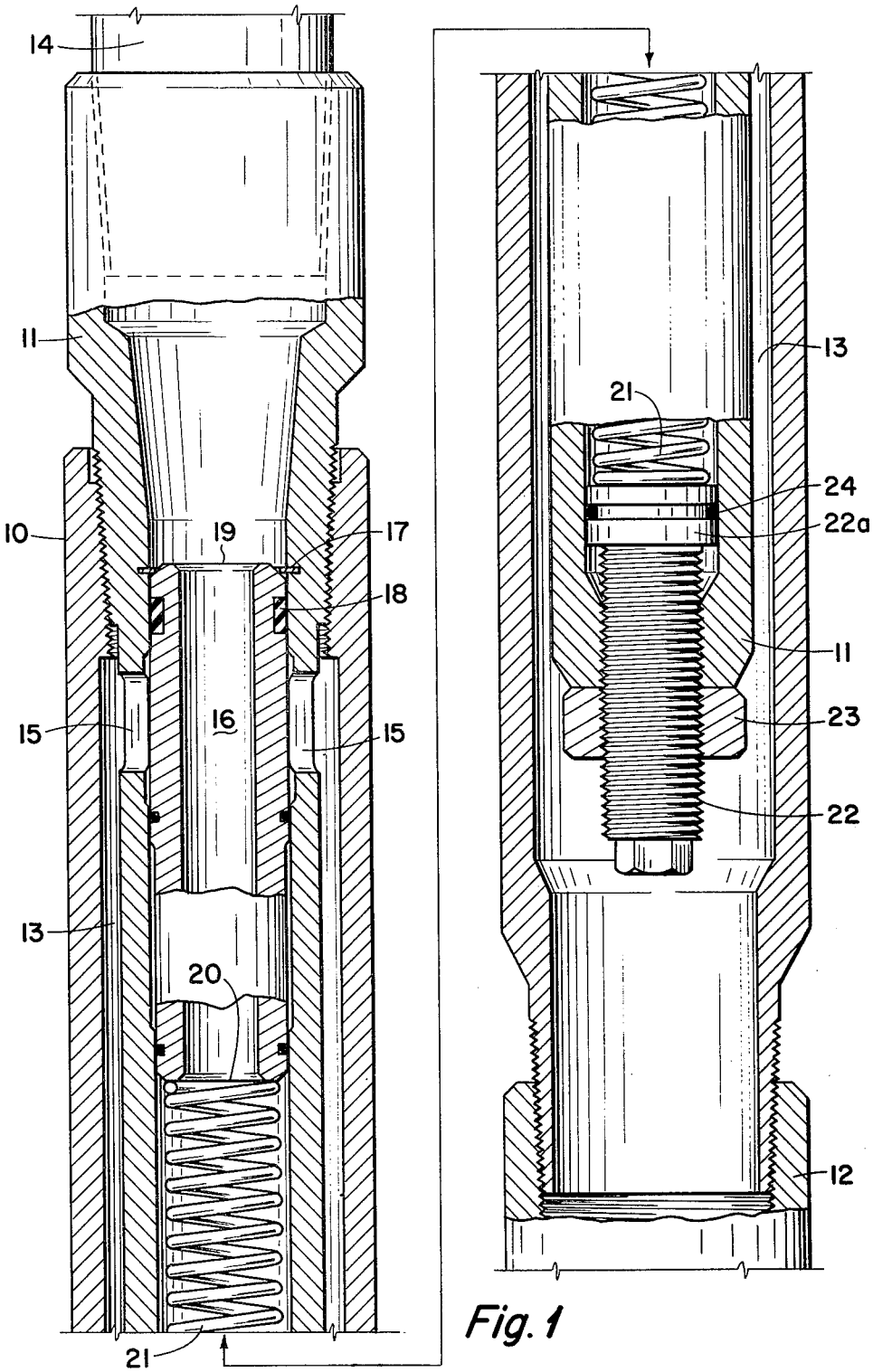
FIG. 1 is a front elevation view, mostly in section, which illustrates the fluid control tool of this invention when the piston is in its closed position.

Referring now to the drawing, the fluid control tool illustrated herein is made up of several components. In general, the outside of the tool is defined by an elongate coupling 10. The top end of coupling 10 threads onto a piston housing 11 and the bottom end threads into a lower tubing section 12. Coupling 10 encloses housing 11, with a space 13 being defined between the inner wall surface of the coupling and the outer wall surface of the piston housing. Space 13 provides an annular chamber for carrying fluid from the piston housing down into the lower tubing string section 12.

The top end of housing 11 is adapted for threading onto an upper tubing string section 14. Near the top end of housing 11 are fluid outlet ports 15, which open into the annular chamber 13. A tubular piston 16 is positioned, with a slide fit, inside the housing 11. The slide fit enables the piston to move up and down within the housing. A retainer ring 17 is seated in the bore of the piston housing 11 above the top end of piston 16. Ring 17 thus provides an upper stop means for the piston 16.

A corrosion-resistant, synthetic rubber material is bonded to the piston 16 just below the top end of the piston. This rubber material provides a fluid-tight seal 18 between the piston 16 and housing 11. Additional fluid-tight seals between the piston and the housing are provided by two O-rings (not numbered) which are positioned on the piston below the bonded seal 18. The flat top face of piston 16, which is indicated by numeral 19, has a surface area which is slightly larger than the surface area of the bottom face 20. In the tool described herein the surface area of the top face 19 is from about 4 percent to about 5 percent larger than the bottom face 20.

The bottom face 20 of piston 16 seats down against the top end of a compression spring 21. In turn, the bottom end of the spring seats down against a flat head **22*a* of an adjusting bolt 22. Bolt 22 has external threads thereon which are engageable with internal threads in the bottom end of the piston housing 11. This thread engagement enables the bolt to screw up and down within the housing 11, to adjust the compression on spring 21. A lock nut 23 is threaded over bolt 22. When it is desired to lock the bolt 22 in a given position on the housing, the nut 23 is run up against the bottom end of the housing. An O-ring 24 is mounted on the head 22***a* of bolt 22, to provide a fluid tight seal at the bottom end of the piston housing 11.

OPERATION

It was explained earlier that the tool of this invention is specifically designed for downhole operations in formations in which the bottom hole pressure is less than the hydrostatic pressure of the treating fluid in the tubing string at the actual formation depth. The purpose of this tool is to prevent the treating fluid from flowing out of the tubing string prior to the time it is to be released for performing the downhole operation. Examples of downhole operations in which this tool can be used are hydraulic fracturing, or acidizing, of a producing zone. This tool can also be used in conjunction with a conventional wash tool to clean out corrosion sediment which collects in well casing perforations, or in the slots of slotted liners which are installed in the casing.

A typical operation for washing the slotted liners will now be described to illustrate the practice of this invention. In this operation the tubing string will include the upper tubing section 14, the lower tubing string section 12, the fluid control tool positioned between the tubing string sections and a conventional wash tool (not shown), which is fastened to the lower tubing string section. Before the tubing string is run into the casing the differential piston 16 is moved up in the piston housing 11 to its closed position, by adjustment of spring 21 with bolt 22. When the piston is in its closed position, as illustrated in FIG. 1, the piston completely closes off the fluid outlet ports 15.

The tubing string is then run into the well casing until the wash tool is adjacent to the slotted liners to be washed. The next step is to fill the tubing string with an acid composition, or some other suitable washing fluid, in a quantity sufficient to wash out the slotted liners. With the fluid outlet ports 15 being closed off by piston 16, the wash fluid is contained within the lower part of the piston housing 11 and within the piston itself. The load applied to spring 21 can then be adjusted by bolt 22, such that the spring force will overcome the hydrostatic pressure of the wash fluid at the depth at which the job is to be performed. This adjustment feature prevents the piston 16 from being pumped downwardly and releasing the wash acid into the annular chamber 13 prematurely.

Figure 2:
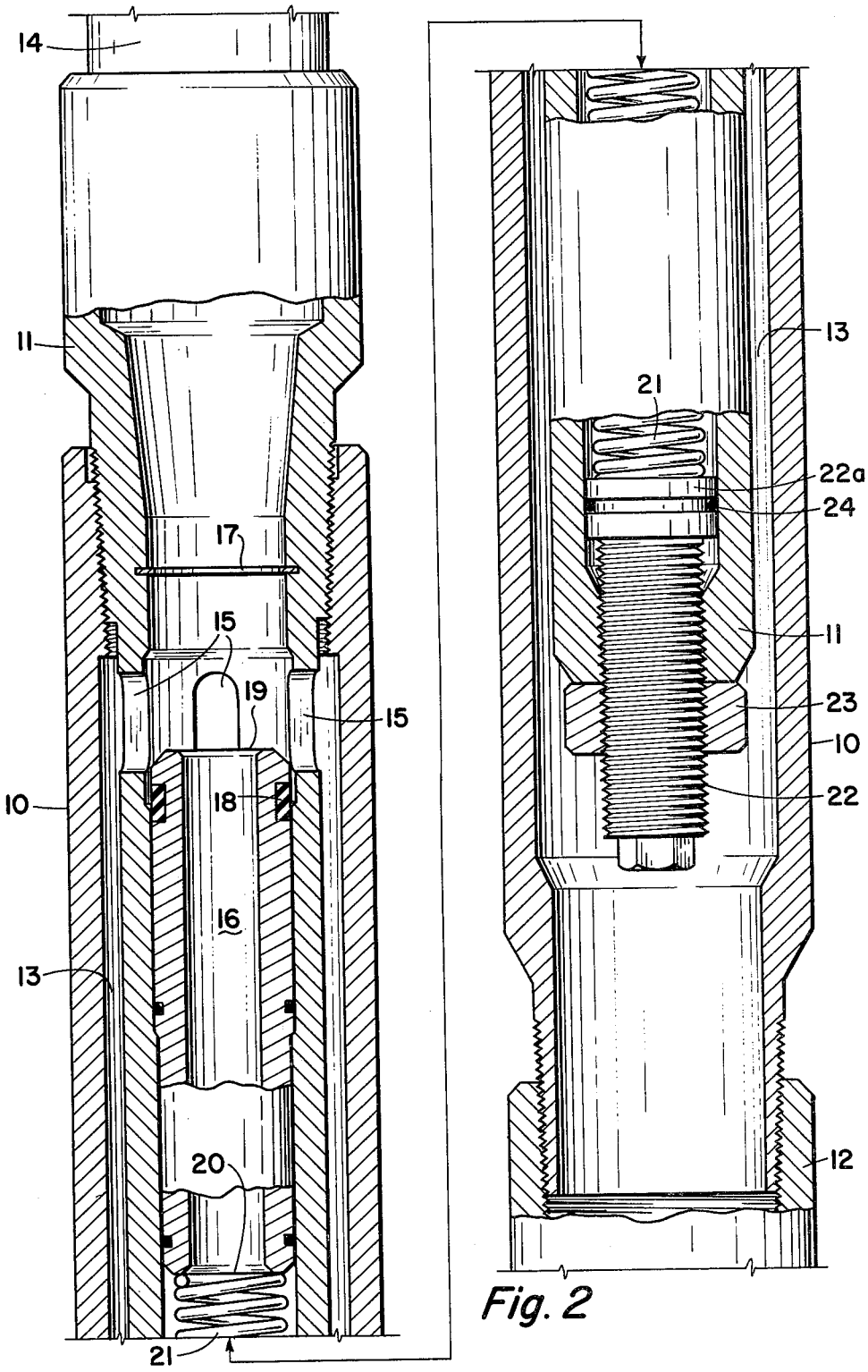
FIG. 2 is a front elevation view, similar to FIG. 1, which illustrates the piston in its open position.

The next step involves applying sufficient pressure to the wash fluid column in the tubing string to overcome the predetermined load which spring 21 exerts against the piston 16. The additional pressure is provided by pumping salt water, or fresh water, behind the wash fluid until the resulting differential pressure against the top face 19 of piston 16 moves the piston down to its open position. When the piston is in the open position, as illustrated in FIG. 2, the top face of the piston moves down far enough to allow the wash fluid to unload through the fluid outlet ports 15 and into the annular chamber 13. As the fluid flows into the chamber 13, it drops through the lower tubing section 12 and into the wash tool.

A particularly unique feature of this invention is the use of a differential piston to control the release of fluid from the tubing string. It was mentioned earlier that the top face 19 of piston 16 has a total surface area which is about 4 percent to 5 percent larger than the surface area of the bottom face 20 on the piston. Since the top face of the piston is larger, there is a substantial difference in the fluid pressure which acts against the top face of the piston, as opposed to the bottom face of the piston. Because of this pressure differential, the piston can be moved downwardly to overcome the force of spring 21 by applying a relatively small amount of additional pressure against the fluid contained in the tubing string.

The invention claimed is:

1. A downhole tool for controlling fluid flow into a low pressure earth formation, the tool comprising:

an elongate coupling having a top end connected onto a piston housing, and a bottom end adapted for connecting into a lower section of a tubing string, the lower string being adapted for carrying fluid to the formation;

the piston housing enclosed by and spaced from the coupling, the space defining an annular chamber, the housing including at least one fluid outlet port which communicates with the annular chamber, the housing having a top end adapted for connecting into an upper section of a tubing string;

a tubular piston having a top face and bottom face, the top face having a larger surface area than the bottom face, the piston being positioned inside the housing and slidable therein to a first position which closes the fluid outlet port, and to a second position which opens the fluid outlet port;

an adjusting member which includes a head portion, said adjusting member being mounted at the bottom end of the piston housing, and capable of moving up and down within the housing;

an elastic member which seats against the head portion of the adjusting member and the bottom face of the piston;

whereby, the adjusting member and elastic member co-act to hold the piston in the first position, and thereafter the application of fluid pressure against the top face of the piston is sufficient to move the piston to the second position, to allow the fluid to pass through the annular chamber and into the lower tubing string section.

2. A tool for controlling fluid flow from a tubing string into an earth formation in which the bottomhole pressure is less than the normal hydrostatic pressure of the fluid in the tubing string, the tool comprising:

an elongate coupling having a top end connected onto a piston housing, and a bottom end connected into a lower section of the tubing string, the lower string being adapted for carrying fluid to the formation;

the piston housing enclosed by and spaced from the coupling, the space defining an annular chamber, the housing including at least one fluid outlet port which communicates with the annular chamber, the housing having a top end adapted for connecting into an upper section of the tubing string;

a tubular piston having a top face and bottom face, the top face having a larger surface area than the bottom face, the piston being positioned inside the housing and slidable therein to a first position which closes the fluid outlet port, and to a second position which opens the fluid outlet port;

an adjusting bolt having external threads and a head portion, the bolt being threaded into the bottom end of the piston housing, such that it can move up and down within said housing;

a spring member which seats against the head portion of the bolt and the bottom face of the piston;

whereby, the bolt is adapted for adjusting sufficient tension on the spring to hold the piston in the first position, and thereafter the application of a predetermined amount of fluid pressure against the top face of the piston is sufficient to move the piston to the second position, to allow the fluid in the tubing string to pass through the annular chamber into the lower tubing string section.

3. The tool of claim 2 which further includes a wash tool connected into the lower tubing string section, the wash tool being adapted to receive the fluid which flows through the annular chamber and into said lower tubing string.

4. The tool of claim 2 in which the surface area of the top face of the piston is from about 4 percent to 5 percent larger than the surface area of the bottom face of the piston.

5. The tool of claim 2 which further includes a piston retainer means mounted in the piston housing above the fluid outlet port.

6. The tool of claim 2 which further includes a lock nut, which threads onto the adjusting bolt and seats against the bottom end of the piston housing, to lock the adjusting bolt into the piston housing.

7. The tool of claim 2 which further includes a fluid seal means mounted on the head portion of the adjusting bolt and in contact with the inner wall surface of the piston housing.

8. Method for controlling fluid flow from a tubing string into an earth formation having a bottomhole pressure less than normal hydrostatic pressure of a treating fluid contained in the tubing string, the method comprising the steps of:

attaching a tool onto a tubing string, the tool including a tubular piston slidably enclosed in a housing with a fluid outlet port therein, the piston having a top face with a larger surface area than the bottom face of the piston, and the tool including means for adjusting the position of the piston within the housing;

lowering the tool on the tubing string to a point above a zone in the formation to be treated with the fluid;

filling an upper section of the tubing string with the treating fluid, such that the fluid is in contact with the piston and the housing;

applying sufficient upward force against the piston, with the adjusting means, to exceed the hydrostatic pressure force of the treating fluid against the piston;

moving the piston with the upward force to a position which closes off the fluid outlet port, and contains the treating fluid within the piston and the housing;

applying enough fluid pressure against the top face of the piston to overcome the upward force of the adjusting means and thereby move the piston downwardly below the fluid outlet port; and allowing the treating fluid to pass through the fluid outlet port and into a lower section of the tubing string adjacent to the formation to be treated.

* * * * *